United States Patent [19]

Loban

[11] Patent Number: 4,548,391

[45] Date of Patent: Oct. 22, 1985

[54] FIBER CRAFT HOLDER

[76] Inventor: Gillian Loban, 115 Maple Court Crescent SE., Calgary, Alberta, Canada, T2J 1V9

[21] Appl. No.: 501,053

[22] Filed: Jun. 9, 1983

Related U.S. Application Data

[63] Continuation-in-part of Ser. No. 308,571, Oct. 5, 1981, abandoned.

[30] Foreign Application Priority Data

Dec. 17, 1980 [CA] Canada ..... 366935

[51] Int. Cl.[4] ..... B25B 1/22

[52] U.S. Cl. ..... 269/47; 269/97; 269/909

[58] Field of Search ..... 269/97, 98, 252, 47, 269/328, 906, 909; 248/441 C, 441 B, 457, 458, 454, 226.3, 226.4

[56] References Cited

U.S. PATENT DOCUMENTS

| | | | |
|---|---|---|---|
| 357,548 | 7/1935 | Des Isles . | |
| 571,068 | 11/1896 | Fillebrown | 248/457 |
| 2,009,044 | 7/1935 | Davis . | |
| 3,106,376 | 10/1963 | Scott . | |
| 3,173,674 | 3/1965 | Ringle | 269/97 |
| 3,799,487 | 3/1974 | Durrant | 248/441 C |
| 3,861,664 | 1/1975 | Durkee | 269/906 |
| 3,899,164 | 8/1975 | Newman | 248/454 |
| 4,054,282 | 10/1977 | Hamer | 269/328 |
| 4,109,889 | 8/1978 | Durket . | |
| 4,126,304 | 11/1978 | Barck | 269/97 |
| 4,163,539 | 8/1979 | Awofolu | 248/457 |
| 4,294,441 | 10/1981 | O'Banion et al. | 269/97 |

FOREIGN PATENT DOCUMENTS 357548 5/1936 Canada .

*Primary Examiner*—Robert C. Watson

*Attorney, Agent, or Firm*—Harold H. Dutton, Jr.; George H. Dunsmuir

[57] ABSTRACT

A work holder designed for use by the blind and other handicapped persons includes an elongated top plate for mounting on a table top with the ends thereof extending outwardly beyond the edge of the top; a pair of small bottom plates slidably connected to the ends of the top plate by guide bars and screws, the bottom plates being mounted beneath the table top, the top and bottom plates clamping the work holder to the table top; and a pair of posts on the top plate for supporting a work holding frame such as a weaving or quilting frame. Large knobs are provided on the screws for facilitating gripping of the screws.

2 Claims, 4 Drawing Figures

FIBER CRAFT HOLDER

CROSS REFERENCE TO RELATED APPLICATION

This application is a continuation-in-part of copending application Ser. No. 308,571 filed Oct. 5, 1981 now abandoned.

BACKGROUND OF THE INVENTION

This invention relates to a work holder, and in particular to a work holder for handicapped persons.

While the work holder of the present invention is primarily intended for use by the blind and other handicapped persons, the work holder can be used by anyone for a variety of purposes. Because the work holder is basically a bracket on which a work holding frame or plate can be mounted, the uses of the holder are numerous.

There are many work holders described in the patent literature. Examples of such holders are those disclosed by Canadian Pat. No. 357,548, issued to L. H. DesIsles on May 5, 1936; and U.S. Pat. Nos. 2,009,044, issued to J. O. Davis on July 25, 1935; 3,106,376, issued to R. J. Scott on Oct. 8, 1963; and 4,109,889, issued to M. P. Durket on Aug. 29, 1978. From the present inventor's point of view, the disadvantages of such work holders are that they are either totally unsuited to use by the handicapped or that they are structurally complicated.

The object of the present invention is to avoid the disadvantages of the prior art by providing a relatively simple, easy to mount work holder.

SUMMARY OF THE INVENTION

Accordingly, the present invention relates to a work holder for mounting on one edge of a table top or the like comprising bracket means including first plate means for mounting above said top; first arm means integral with said first plate means for extending outwardly from each end of the first plate means beyond the edge of said top; second plate means for mounting below said top; second arm means integral with said second plate means for extending outwardly beneath each said first arm means; guide means extending between said first and second arm means for slidably interconnecting said first and second arm means and for maintaining said first and second plate means in substantially parallel relationship to each other; screw means extending between said arm means for moving said first and second plate means toward and away from each other and holding said first and second plate means in one position on said top; and support means for supporting a work holding frame on said first plate means.

With the device described above, a plate defining the top of the bracket means is maintained on the table top, while bottom plates at each end of the top plate are beneath the table top. Screws extending through the top and bottom plates are turned to move the bottom plates with respect to the top plate, so that the plates grip the table top to securely mount the device on the edge of the table top. Large knobs on the top ends of the screws facilitate turning of the screws, and make the device easier to use.

BRIEF DESCRIPTION OF THE DRAWINGS

The invention will now be described in greater detail with reference to the accompanying drawings, which illustrate a preferred embodiment of the invention, and wherein.

DESCRIPTION OF THE PREFERRED EMBODIMENT(S)

Figure 1:
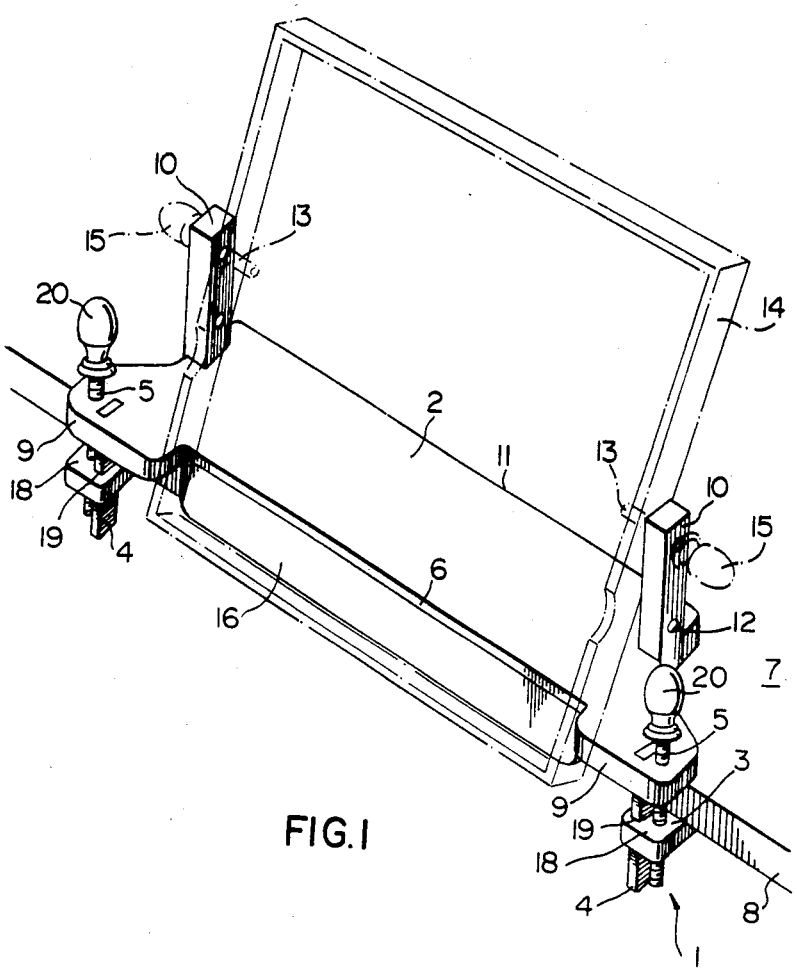
FIG. 1 is a perspective view from above and one side of a work holder in accordance with the present invention mounted on a table top.
Figure 2:
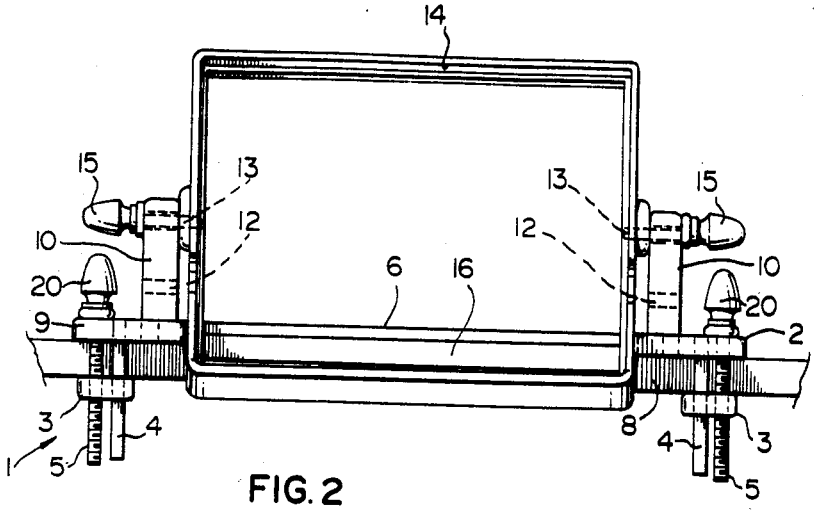
FIG. 2 is a front view of the device and table top of FIG. 1.
Figure 3:
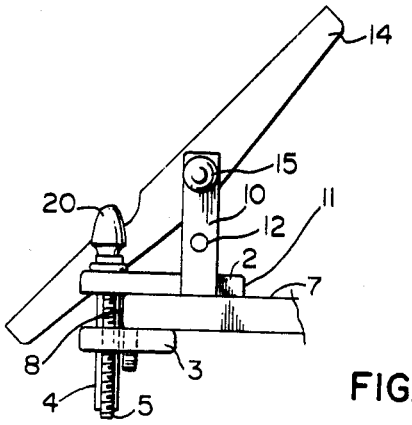
FIG. 3 is a side elevation view of the work holder of FIGS. 1 and 2.

Referring to the drawings, the work holder of the present invention includes a bracket generally indicated at 1 for mounting the holder on a table. The bracket 1 is defined by a top plate 2, bottom plates 3, guide bars 4 and screws 5. The top plate 2 includes an elongated central portion 6 for resting on a table top 7 near one edge 8 thereof, and a forwardly and outwardly extending arm 9 at each end thereof.

A pair of upstanding posts 10 extend upwardly from the ends of the central portion 6 of such top plate 2 near rear edge 11. Holes 12 are provided in each post 10 for receiving a screw 13 which permits the mounting of a rectangular quilting frame 14 between the posts. The holes 12 may be threaded so that screws 13 extend through the holes 12 into blind, unthreaded holes in the frame 14, whereby turning the screws 13 into the frame will exert a clamping force against the frame 14. Alternatively, the holes 12 may be unthreaded so that the screws 13 extend into threaded holes (not shown) in the frame 14, whereby turning the screws into the frame will draw the frame against the posts 10 and clamp the frame against the posts 10.

Instead of the quilting frame 14 shown, other work holders such as an easel, drawing board, embroidery holder, loom, or the like may be similarly supported between the posts 10, and adjusted appropriately. In addition, a plurality of vertically spaced holes may be provided in the posts 10, to enable a degree of vertical adjustment of the work holder. Such additional holes would be similarly configured to the holes 12, so that the same clamping arrangement could be used.

By tightening the screws 13, the frame 14 can be fixed in one position, and, by loosening the screws 13 slightly, the frame 14 can be tilted to another position, and fixed by retightening the screws 13. In addition, the screws 13 can be loosened to the point where the frame 14 can be removed. Large, oversized knobs 15 are provided on the outer ends of the screws 13 for facilitating gripping and turning of the screws.

Figure 4:
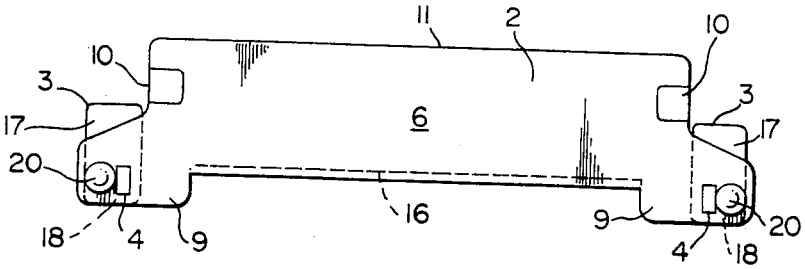
FIG. 4 is a plan view of the work holder of FIGS. 1 to 3.

A plate 16 extends downwardly from the front edge of the central portion 6 of the top plate 2 for accurately positioning the work holder with respect to the edge 8 of the table top 7. Each bottom plate 3 is rectangular, with a rear portion 17 (FIG. 4) positioned beneath the table top 7 when in use and a front portion or arm 18, which extends outwardly beyond the edge 8 of the table top 7 beneath the arm 9 of the top plate 2. The bars 4 are securely mounted in the arms 9 of the top plate 2 and extend downwardly through openings 19 in the bottom plate 3. The openings 19 are slightly larger than the cross-sectional area of the bars 4, so that the bottom plates 3 can slide vertically toward and away from the top plate 2 for removably mounting the work holder on the edge of the table top 7.

The top plate 2 and bottom plates 3 are moved with respect to each other by means of the screws 5, which extend through aligned, holes in the arms 9 and 18. The holes in the upper arms 9 are unthreaded, while the holes in the lower arms 18 are threaded, so that upon tightening the screws 5, the knobs 20 are urged against the surface of the plate 2 and the bottom plates 3 are drawn upwardly against the underside of the table top 7 so as to clamp the work holder to the table top 7. As in the case of the screws 13, large knobs 20 are provided on the upper ends of the screws 5 to facilitate gripping and turning of such screws.

The manner of using the work holder is obvious from the foregoing description. As mentioned, the large knobs 15 and 20 on the screws 13 and 15, respectively, facilitate gripping and turning of the screws. Furthermore, the guide bars 4 maintain proper positioning of the bottom plates 3. Thus, the work holder can readily be mounted and used by the blind and other handicapped persons.

Preferably, the entire work holder including the screws is constructed of wood, which is both lightweight and smooth. Plastic may also be used. It will be noted that the corners of all of the elements are rounded to prevent injury to the user.

Further modifications and alternative embodiments of the invention will be apparent to those skilled in the art in view of the foregoing description. Accordingly, this description is to be construed as illustrative only and is for the purpose of teaching those skilled in the art, the manner of carrying out the invention. It is further understood that the form of the invention herewith shown and described is to be taken as the presently preferred embodiment. Various changes may be made in the shape, size and general arrangement of components, for example, equivalent elements may be substituted for those illustrated and described herein, parts may be used independently of the use of other features, all as will be apparent to one skilled in the art after having the benefits of the description of the invention.

What I claim is:

1. A work holder for supporting a work holding frame for use by handicapped persons for mounting on the edge of a table top or the like comprising a top plate member for mounting above the table top and including a pair of laterally spaced integral first arm portions projecting from said top plate member beyond the edge of the table top; a pair of bottom plate members for mounting below the table top and each including integral second arm portions extending beyond the edge of the table top and beneath said first arm portions; guide means extending between the superjacent of said first and second arm portions and slidably interconnecting said first and second arm portions for maintaining said top and bottom plate members in substantially parallel relationship to each other on opposite sides of the table top, said guide means including a bar connected to each of said first arm portions and extending downwardly therefrom; each said second arm portions having an opening for receiving said bar, whereby the bottom plate members are vertically slidable with respect to said top plate member; screw means including elongated screws extending through said first arm portions and threadedly engaging said second arm portions for moving said top and bottom plate members toward and away from each other so as to clamp the table top between said top and bottom plate members in position on the table top; and support means upstanding from said top plate member for supporting a work holding frame on said top plate member.

2. A work holder as in claim 1 and including large, oversize knobs on the upper end of said screw means so as to facilitate turning of said screw means.

* * * * *